US010349784B2

(12) United States Patent
Lieb et al.

(10) Patent No.: US 10,349,784 B2
(45) Date of Patent: Jul. 16, 2019

(54) HINGED WALL PROFILE DOOR

(71) Applicant: Bath Authority LLC, Warminster, PA (US)

(72) Inventors: Brian Lieb, Philadelphia, PA (US); Vadym Mironchuk, Southampton, PA (US); Michael Minkovich, Richboro, PA (US)

(73) Assignee: BATH AUTHORITY LLC, Warminster, PA (US)

( * ) Notice: Subject to any disclaimer, the term of this patent is extended or adjusted under 35 U.S.C. 154(b) by 208 days.

(21) Appl. No.: 15/610,916

(22) Filed: Jun. 1, 2017

(65) Prior Publication Data

US 2018/0344098 A1 Dec. 6, 2018

(51) Int. Cl.
*A47K 3/36* (2006.01)
*E05D 5/02* (2006.01)
(Continued)

(52) U.S. Cl.
CPC ..... *A47K 3/36* (2013.01); *E05B 1/0015* (2013.01); *E05C 19/16* (2013.01); *E05D 3/08* (2013.01); *E05D 5/0246* (2013.01); *E05D 5/10* (2013.01); *E05D 5/14* (2013.01); *E05D 7/1005* (2013.01); *E05D 7/1044* (2013.01); *E06B 3/36* (2013.01); *A47K 2003/307* (2013.01); *E05D 2005/102* (2013.01); *E05D 2007/1027* (2013.01); *E05Y 2800/20* (2013.01); *E05Y 2800/205* (2013.01); *E05Y 2900/114* (2013.01)

(58) Field of Classification Search
CPC ..... A47K 3/36; E06B 3/36; E05D 5/0246; E05D 7/1005
See application file for complete search history.

(56) References Cited

U.S. PATENT DOCUMENTS 2,739,674 A * 3/1956 Casebolt ..... E06B 1/18 49/505
D263,778 S 4/1982 Thompson
(Continued)

FOREIGN PATENT DOCUMENTS

DE 9315801 1/1994
DE 9315801 U1 * 3/1994 ..... A47K 3/36
(Continued)

OTHER PUBLICATIONS

Partial European Search Report dated May 4, 2018, in Application No. EP 17192230.5.

*Primary Examiner* — Marcus Menezes
(74) *Attorney, Agent, or Firm* — Fox Rothschild LLP

(57) ABSTRACT

A hinged wall profile door assembly including a first and second longitudinal wall profile having a body configured for mounting to a wall, and a longitudinal hinge profile having a body configured to be received within an inner section of the first longitudinal wall profile. The assembly also includes a profile door, at least a first hinge assembly and a second hinge assembly secured to the longitudinal hinge profile and configured for mounting to the profile door, the first and second hinge assemblies having a body and a first end and a second end, wherein the first end of the body is configured to be curved and the second end of the body is configured to form a longitudinal channel for receiving the profile door therethrough.

11 Claims, 6 Drawing Sheets

(51) Int. Cl.

| | |
|---|---|
| ***E05D 5/14*** | (2006.01) |
| ***E05D 7/10*** | (2006.01) |
| ***E05B 1/00*** | (2006.01) |
| ***E05C 19/16*** | (2006.01) |
| ***E05D 3/08*** | (2006.01) |
| ***E05D 5/10*** | (2006.01) |
| ***E06B 3/36*** | (2006.01) |
| *A47K 3/30* | (2006.01) |

(56) References Cited

U.S. PATENT DOCUMENTS

| | | | | |
|---|---|---|---|---|
| 4,375,736 | A | 3/1983 | Teckchandani | |
| 5,448,799 | A * | 9/1995 | Stein, Jr. | E05D 5/10 16/225 |
| D378,616 | S | 3/1997 | Marinoni | |
| 5,867,869 | A * | 2/1999 | Garrett | A47K 3/36 16/252 |
| 5,867,871 | A * | 2/1999 | Tasman | E05D 11/1014 16/335 |
| 6,035,460 | A * | 3/2000 | Borter | A47K 3/36 4/605 |
| D792,566 | S | 7/2017 | Wei | |
| 9,803,404 | B2 * | 10/2017 | Cobb | E05D 7/081 |
| 9,845,627 | B2 | 12/2017 | Loggen et al. | |
| 2006/0207060 | A1 * | 9/2006 | Cheng | E05D 5/0246 16/252 |
| 2007/0151164 | A1 * | 7/2007 | Marshall | A47K 3/36 49/397 |
| 2010/0275410 | A1 * | 11/2010 | Chang | E05D 5/0246 16/277 |

FOREIGN PATENT DOCUMENTS

| | | | | |
|---|---|---|---|---|
| DE | 29803092 U1 * | 6/1998 | | A47K 3/36 |
| EP | 1916369 | 4/2008 | | |
| EP | 3146877 | 3/2017 | | |
| EP | 3146877 A1 * | 3/2017 | | A47K 3/36 |
| FR | 2710944 | 4/1995 | | |
| FR | 2710944 A1 * | 4/1995 | | A47K 3/36 |
| WO | WO-02052117 A1 * | 7/2002 | | A47K 3/36 |

* cited by examiner 16
24
30
18
42
34
12

38
44
100
64
50
66
56
22
26
60
14
52
16
98
54
46
20
18
40
38
100
22
28
32
44
36
58

HINGED WALL PROFILE DOOR

TECHNICAL FIELD

The present invention relates to the field of bathroom hardware, and more particularly, to a hinged wall profile door, for example, a hinged wall profile glass door of a shower enclosure.

BACKGROUND

For many years, the most commonly used enclosure for a tub/shower bathing facility has included a pair of sliding glass doors framed in metal. In a typical installation, an outer metal frame circumscribes the entry to the bath and is attached at the sides to the walls of the facility. The installation also includes a header spanning the entrance and a guide rail attached to the tub or shower base. The shower doors are hung at the top from the header and guided at the bottom by the rail so that they can slide back and forth in the entryway to allow entry and egress and to create a splash barrier.

There are several disadvantages with the described installation, both functional and aesthetic. First, the support structure is always present in the entryway to the bathing area, thus always at least partially blocking the entrance and restricting free access to the bathing area, a special problem when bathing a small child or when cleaning the facility. The header also adds an undesired obstruction in the entryway, which must be avoided when entering or leaving the area. Moreover, the metal of the frame and all the glass-to-metal interfaces require special cleaning and maintenance. Apart from these functional constraints, the metal required for the framing, header and rail detracts from a clean and open appearance of the facility.

Various systems eliminating the shower door header have been utilized, including enclosure systems with the shower door hingedly or slidably connected to a glass panel, which is in turn mounted to an adjacent wall. Conventional enclosure systems are disadvantageous in that they use more hardware material than is desired and hence are heavier or obtrusive in appearance. In addition, the hardware of conventional enclosure systems is typically cast and thus has higher manufacturing costs. Further, hingedly connected shower doors of conventional enclosure systems have hinges that do not separate and allow the pins to be moved within the pivot pin system. Also, hinged doors have limited adjustability for out-of-plumb wall conditions.

It would thus be desirable to have an improved hinged door design, among other desirable features as described herein, while avoiding the disadvantages of the known conventional enclosure systems.

SUMMARY

In a first aspect, there is provided herein a hinged wall profile door assembly for a shower enclosure. The assembly includes: a first and a second longitudinal wall profile having a body configured for mounting to a wall; a longitudinal hinge profile having a body configured to be received within an inner section of the first longitudinal wall profile; a profile door of variable size and shape; at least a first hinge assembly and a second hinge assembly secured to the longitudinal hinge profile adjacent to a top edge and a bottom edge thereof, the first and second hinge assemblies configured for mounting to the profile door adjacent to a top edge and a bottom edge thereof, the first and second hinge assemblies having a body and a first end and a second end, wherein the first end of the body is configured to be curved and the second end of the body is configured to form a longitudinal channel for receiving the profile door therethrough; a first handle configured to be secured to a front side of the profile door and a second handle configured to be secured to a rear side of the profile door such that the first and second handles are positioned directly opposite from each other; a longitudinal strike rail disposed on an opposite side of the profile door from the top edge to the bottom edge thereof; a longitudinal strike profile having a body configured to be received within an inner section of the second longitudinal wall profile disposed on an opposite end of the shower enclosure from the first longitudinal wall profile; and a bottom longitudinal strip configured to be disposed on the bottom edge of the profile door for deterring liquid from leaking from the shower enclosure.

In certain embodiments, the assembly further includes a side longitudinal strip configured to be disposed on the longitudinal hinge profile with the first and second hinge assemblies secured thereto for deterring liquid from leaking from the shower enclosure. A first magnetic strip is pre-installed on a rear side of the longitudinal strike rail and a second magnetic strip is pre-installed on an inner surface of the longitudinal strike profile such that the first and second magnetic strips are in direct communication when the profile door is closed.

In certain embodiments, the first and second hinge assemblies each include a hinge mechanism with a pair of hinge inserts and at least one hinge such that each hinge is configured to separate, exposing a plurality of pivot pins.

In certain embodiments, the plurality of pivot pins of each hinge mechanism are disposed therebetween the pair of hinge inserts and include top, middle and bottom pins such that the top pin is configured to be shifted vertically, releasing weight on the middle pin, thereby allowing the top pin and subsequently the other two pins to be removed for replacement of the first and second hinge assemblies without having to uninstall the hinged wall profile door assembly.

In certain embodiments, the longitudinal hinge profile is configured to be adjusted when installed within the inner section of the first longitudinal wall profile such that the first and second hinge assemblies are configured to be slidably disposed with the longitudinal hinge profile.

In certain embodiments, the first and second hinge assemblies are mounted to the profile door adjacent to the top edge and the bottom edge thereof via a plurality of fasteners extended therethrough a plurality of corresponding holes defined on an outer surface of a rear side of the body of the first and second hinge assemblies and a pair of gaskets positioned therebetween the first and second hinge assemblies in direct communication with the profile door.

In certain embodiments, the first and second hinge assemblies are manufactured via an extrusion process.

In certain embodiments, the first and second handles are configured to be curved such that the curvature of the first and second handles imitates the curve of a human finger in an inverse position.

In certain embodiments, the first and second handles are secured on an upper midsection of the profile door from the front and rear sides thereof via at least two fasteners extended therethrough at least two corresponding holes defined on an outer surface of the second handle and a pair of gaskets positioned therebetween the first and second handles in direct communication with the profile door.

In certain embodiments, the profile door is configured with a plurality of pre-drilled holes therethrough at the upper midsection thereof for securing the first and second handles thereto.

In certain embodiments, the first and second handles are manufactured via an extrusion process.

In certain embodiments, the profile door is configured with a plurality of pre-drilled holes therethrough adjacent to the top edge and bottom edge thereof for mounting the at least first hinge assembly and second hinge assembly thereto.

In a second aspect, there is provided herein a hinged wall profile door assembly for a shower enclosure. The assembly includes: a first and a second longitudinal wall profile having a body configured for mounting to a wall; a longitudinal hinge profile having a body configured to be received within an inner section of the first longitudinal wall profile; a profile door of variable size and shape; at least a first hinge assembly and a second hinge assembly secured to the longitudinal hinge profile adjacent to a top edge and a bottom edge thereof, the first and second hinge assemblies configured for mounting to the profile door adjacent to a top edge and a bottom edge thereof, the first and second hinge assemblies having a body and a first end and a second end, wherein the first end of the body is configured to be curved and the second end of the body is configured to form a longitudinal channel for receiving the profile door therethrough, the first and second hinge assemblies each including a hinge mechanism with a pair of hinge inserts and at least one hinge such that each hinge is configured to separate, exposing a plurality of pivot pins, wherein the plurality of pivot pins of each hinge mechanism are disposed therebetween the pair of hinge inserts and include top, middle and bottom pins such that the top pin is configured to be shifted vertically, releasing weight on the middle pin, thereby allowing the top pin and subsequently the other two pins to be removed for replacement of the first and second hinge assemblies without having to uninstall the hinged wall profile door assembly; a side longitudinal strip configured to be disposed on the longitudinal hinge profile with the first and second hinge assemblies secured thereto for deterring liquid from leaking from the shower enclosure; a first handle configured to be secured to a front side of the profile door and a second handle configured to be secured to a rear side of the profile door such that the first and second handles are positioned directly opposite from each other on an upper midsection of the profile door; a longitudinal strike rail disposed on an opposite side of the profile door from the top edge to the bottom edge thereof; a longitudinal strike profile having a body configured to be received within an inner section of the second longitudinal wall profile; a first magnetic strip pre-installed on a rear side of the longitudinal strike rail and a second magnetic strip pre-installed on an inner surface of the longitudinal strike profile such that the first and second magnetic strips are in direct communication when the profile door is closed; and a bottom longitudinal strip configured to be disposed on the bottom edge of the profile door for deterring liquid from leaking from the shower enclosure.

Various advantages of this disclosure will become apparent to those skilled in the art from the following detailed description, when read in light of the accompanying drawings.

DETAILED DESCRIPTION

Figure 1:
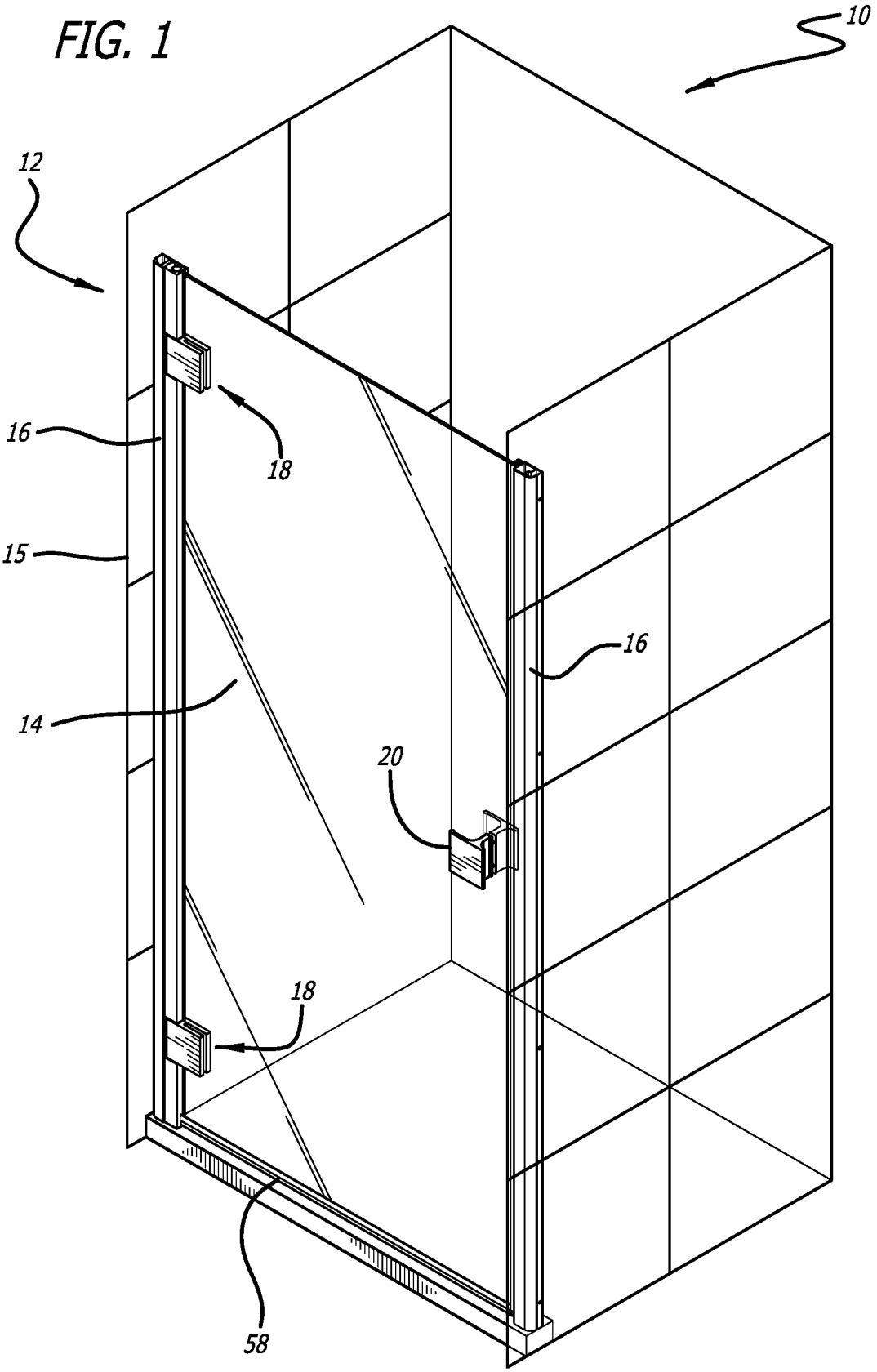
FIG. 1 is a perspective view of an exemplary shower enclosure incorporating a hinged wall profile door assembly in accordance with an embodiment of the present disclosure.

This disclosure is not limited to the particular apparatus, systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All sizes recited in this document are by way of example only, and the present disclosure is not limited to the hinged wall profile door assembly having the specific sizes or dimensions recited herein. As used herein, the term "comprising" means "including, but not limited to."

In consideration of the figures, it is to be understood for purposes of clarity certain details of construction and/or operation are not provided in view of such details being conventional and well within the skill of the art upon disclosure of the document described herein. In the figures, like numerals indicate like elements throughout.

The present disclosure pertains to a hinged wall profile door assembly for a shower enclosure. The hinged wall profile door assembly streamlines and makes more cost-effective the manufacturing process by utilizing an extrusion process for most of the hardware, including the hinge mechanism. The cost of production is greatly reduced by extruding the hardware. The design of the hinged wall profile door assembly allows for easy removal and replacement of the hinge mechanism. In addition, it allows for easy adjustments in out-of-plumb conditions. The hinged wall profile door assembly provides an innovative and balanced visual aesthetic as well as an attractive door that can be offered to customers at a competitively low price. The streamlined and matching hardware provide a desirable aesthetic. The handle is designed to cushion the impact on the user's fingertips and minimizes the chance of discomfort by having a slight curvature that mimics the curve of a human finger in the inverse rather than using a different material. This ergonomic shape causes the user's finger to contact the handle smoothly over a larger surface area instead of the entire force of impact being painfully applied to the fingertip just below the fingernail.

In addition to the advantages described above, the hinge mechanism of the hinged wall profile door assembly features a hinge that separates thus exposing the pivot pins. The offset three-part pivot pin system is disposed therebetween a pair of hinge inserts that allows the top pin to be shifted vertically, releasing the weight on the middle pin and allowing it and subsequently the other two pins to be removed. With the pivot pin split into three parts, the pivot pins can be removed from the hinge inserts so that the entire hinge assembly can be fully replaced without uninstalling the entire hinged wall profile door assembly. The visual balance inherent in the design of the door, with a larger profile on the hinge side and a smaller profile on the strike side, counterpoints the smaller hinges and larger handle. The triangle formed by the hardware is simple and elegant and appears equal on the top and bottom, but the handle is placed slightly higher than the middle, creating a perspective-based illusion of uniformity, among other desirable features as described herein.

Referring now to FIG. 1 is a perspective view of an exemplary shower enclosure 10 incorporating a hinged wall profile door assembly 12 in accordance with an embodiment of the present disclosure. The shower enclosure 10 includes at least one glass panel shower door or profile door 14 secured to a wall 15 via a longitudinal wall profile 16. The profile door 14 is hingedly connected to the longitudinal wall profile 16 by first and second hinge assemblies 18. A handle 20 is positioned slightly higher than the middle of the shower door 14. Such a configuration maintains a clean aesthetic appearance for the shower enclosure 10. It should be understood that the hinged wall profile door assembly 12 is not limited to the shower enclosure 10 illustrated in FIG. 1. The illustrated shower enclosure in FIG. 1 is for illustration only as the hinged wall profile door assembly 12 may be utilized in various shower enclosure configurations.

Figure 2:
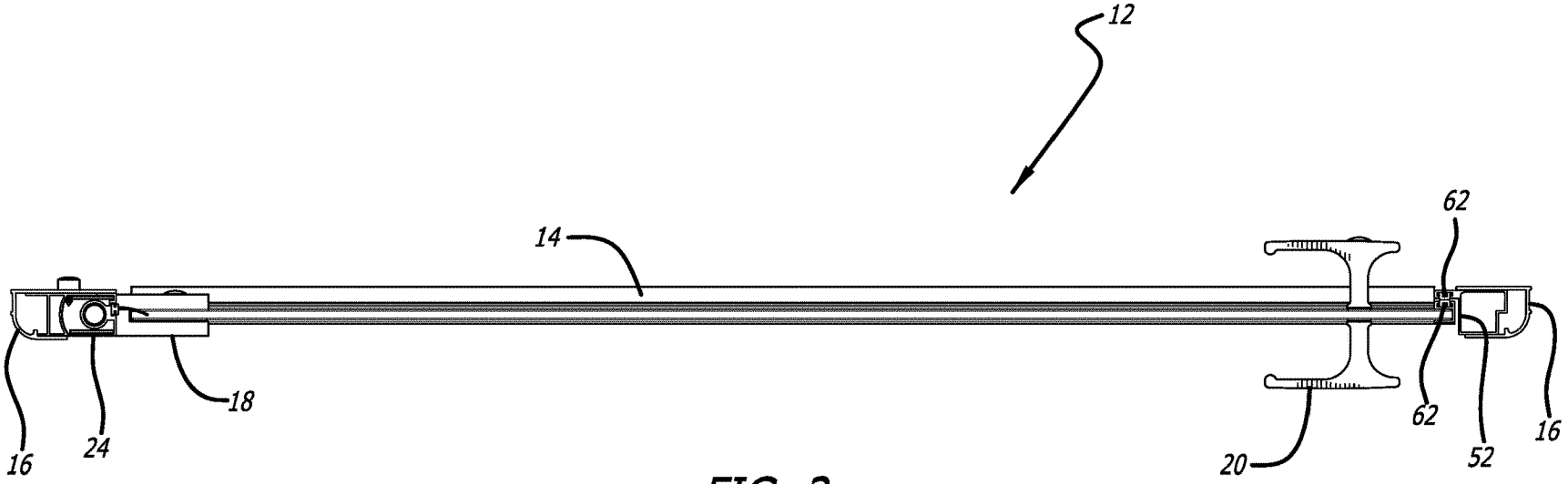
FIG. 2 is a top plan view of the hinged wall profile door assembly of FIG. 1.

FIG. 2 is a top plan view of the hinged wall profile door assembly 12 of FIG. 1.

Referring to FIGS. 2-7, the hinged wall profile door assembly 12 will be described in more detail. The hinged wall profile door assembly 12 generally includes a first and a second longitudinal wall profile 16 each having a body 22 configured for mounting to a wall 15 and a longitudinal hinge profile 24 having a body 26 configured to be received within an inner section 28 of the first longitudinal wall profile 16. At least a first hinge assembly 18 and a second hinge assembly 18 are secured to the longitudinal hinge profile 24 adjacent to a top edge 30 and a bottom edge 32 thereof. The first and second hinge assemblies 18 are configured for mounting to a profile door 14 adjacent to a top edge 34 and a bottom edge 36 thereof. The first and second hinge assemblies 18 each have a body 38 and a first end 40 and a second end 42 in which the first end 40 of the body 38 is configured to be curved and the second end 42 of the body is configured to form a longitudinal channel 44 for receiving the profile door 14 therethrough. A first handle 20 is configured to be secured to a front side 46 of the profile door 14 and a second handle 20 is configured to be secured to a rear side 48 of the profile door 14 such that the first and second handles 20 are positioned directly opposite from each other. A longitudinal strike rail 50 is disposed on an opposite side of the profile door 14 from the top edge 34 to the bottom edge 36 thereof. A longitudinal strike profile 52 having a body 54 is configured to be received within an inner section 56 of the second longitudinal wall profile 16 and disposed on an opposite end of the shower enclosure 10 from the first longitudinal wall profile 16. A bottom longitudinal strip 58 is configured to be disposed on the bottom edge 36 of the profile door 14 for deterring liquid from leaking from the shower enclosure 10.

In accordance with the present disclosure, the hinged wall profile door assembly 12 further includes a side longitudinal strip 60 configured to be disposed on the longitudinal hinge profile 24 with the first and second hinge assemblies 18 secured thereto for deterring liquid from leaking from the shower enclosure 10. A first magnetic strip 62 is pre-installed on a rear side 64 of the longitudinal strike rail 50 and a second magnetic strip 62 is pre-installed on an inner surface 66 of the longitudinal strike profile 52 such that the first and second magnetic strips 62 are in direct communication when the profile door 14 is closed.

Figure 3:
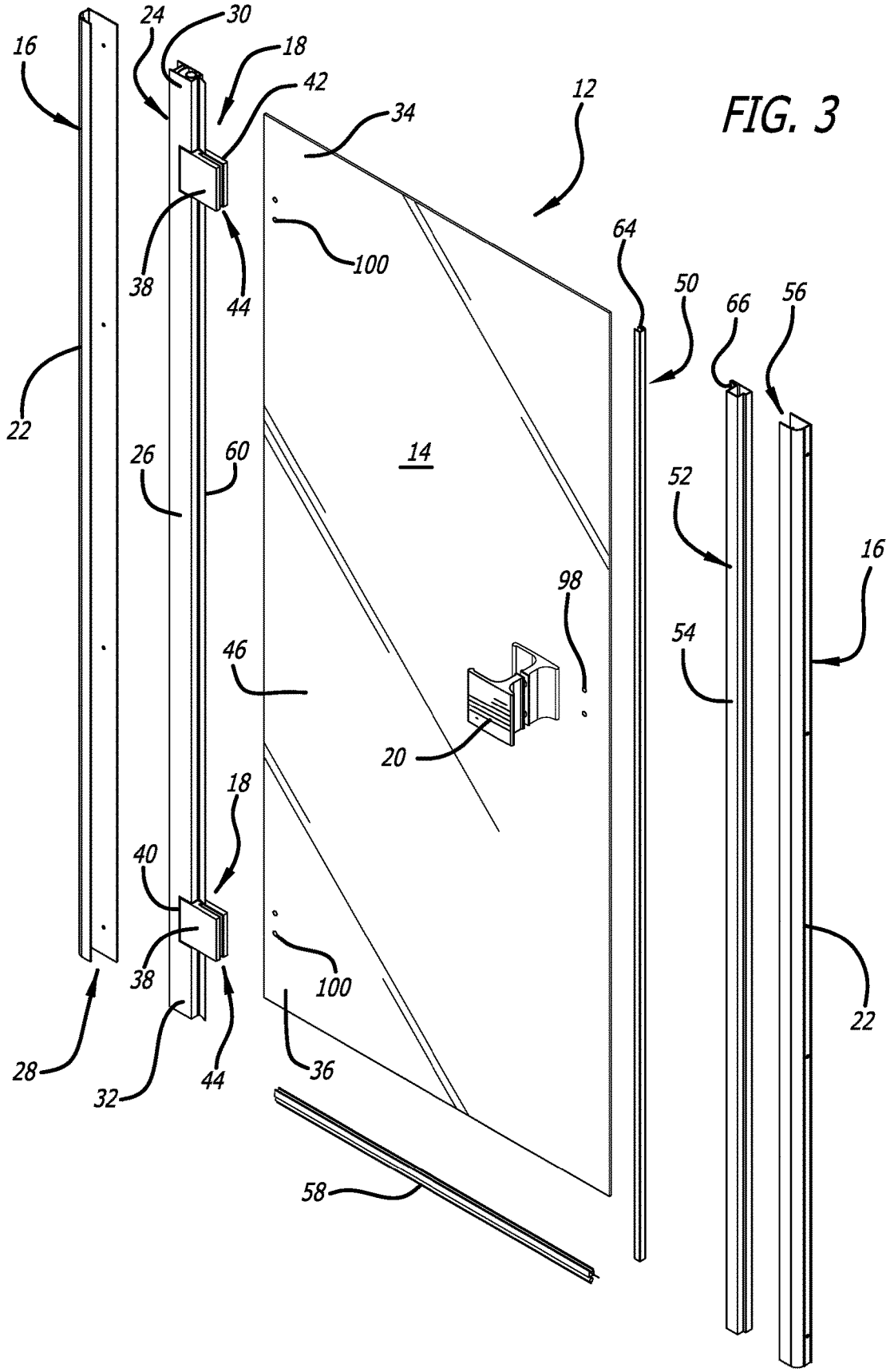
FIG. 3 is an exploded perspective view of the hinged wall profile door assembly of FIG. 1.

FIG. 3 is an exploded perspective view of the hinged wall profile door assembly 12 of FIG. 1.

Figure 4:
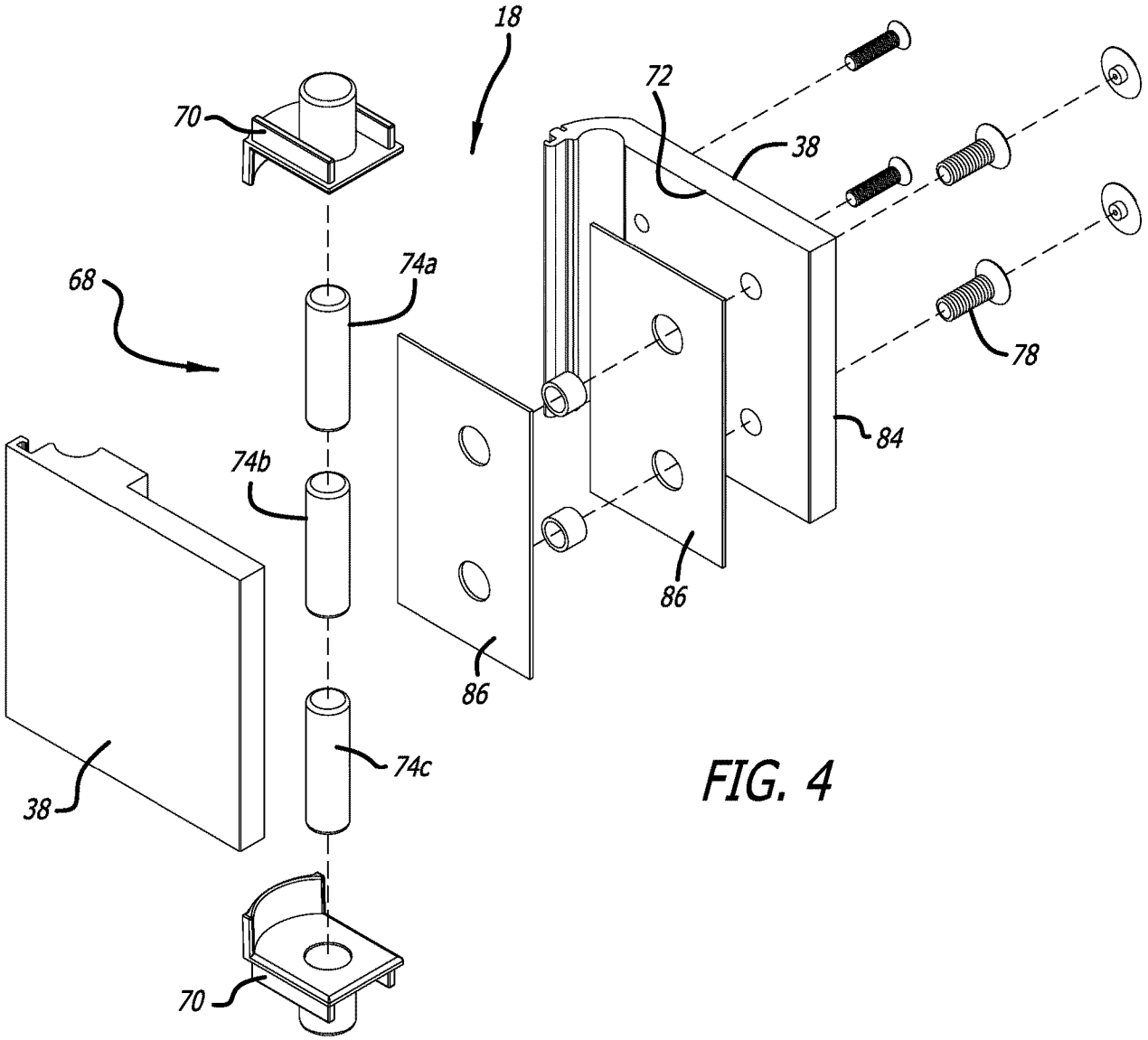
FIG. 4 is an exploded perspective view of an exemplary hinge assembly of the hinged wall profile door assembly of FIG. 1.
Figure 5:
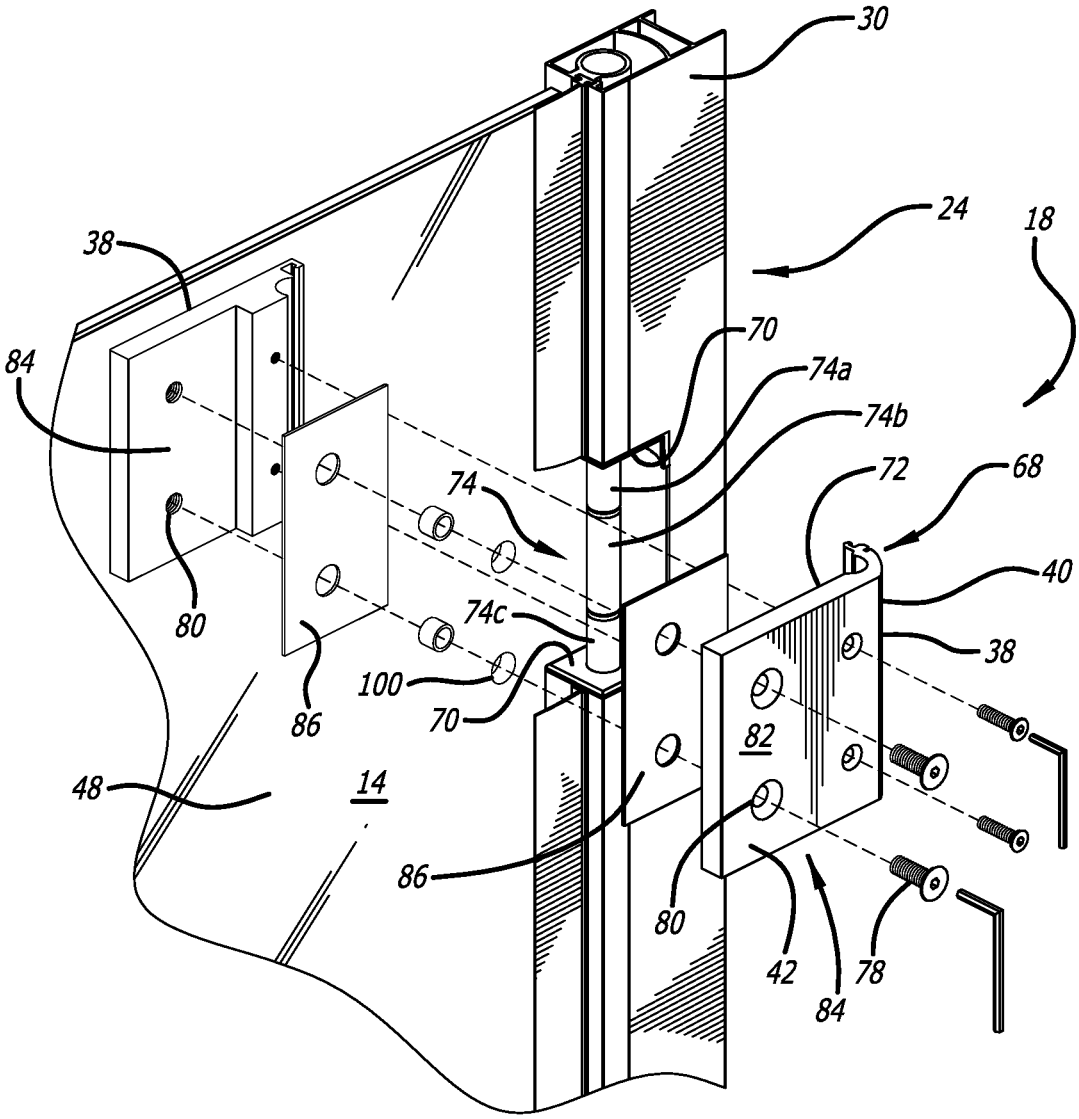
FIG. 5 is an enlarged rear perspective view of the exemplary hinge assembly of FIG. 4 from the inside of the exemplary shower enclosure.

FIG. 4 is an exploded perspective view of an exemplary hinge assembly 18 of the hinged wall profile door assembly 12 of FIG. 1. FIG. 5 is an enlarged rear perspective view of hinge assembly 18 from the inside of the exemplary shower enclosure. In the illustrated embodiments, the first and second hinge assemblies 18 with body 38 each include a hinge mechanism 68 with a pair of hinge inserts 70 and at least one hinge 72 such that each hinge is configured to separate, exposing a plurality of pivot pins 74.

In some embodiments, the plurality of pivot pins 74 of each hinge mechanism 68 are disposed therebetween a pair of hinge inserts 70 and include top, middle and bottom pins 74*a-c* such that the top pin 74*a* is configured to be shifted vertically, releasing weight on the middle pin 74*b*, thereby allowing the top pin 74*a* and subsequently the other two pins 74*b-c* to be removed for replacement of the first and second hinge assemblies 18 without having to uninstall the hinged wall profile door assembly 12.

In other embodiments, the longitudinal hinge profile 24 is configured to be adjusted when installed within the inner section 28 of the first longitudinal wall profile 16 such that the first and second hinge assemblies 18 are configured to be slidably disposed with the longitudinal hinge profile 24.

In further embodiments, the first and second hinge assemblies 18 are mounted to the profile door 14 adjacent to the top edge 34 and the bottom edge 36 thereof via a plurality of fasteners 78 extended therethrough a plurality of corresponding holes 80 defined on an outer surface 82 of a rear side 84 of the body 38 of the first and second hinge assemblies 18 and a pair of gaskets 86 positioned therebetween the first and second hinge assemblies 18 in direct communication with the profile door 14.

Figure 6:
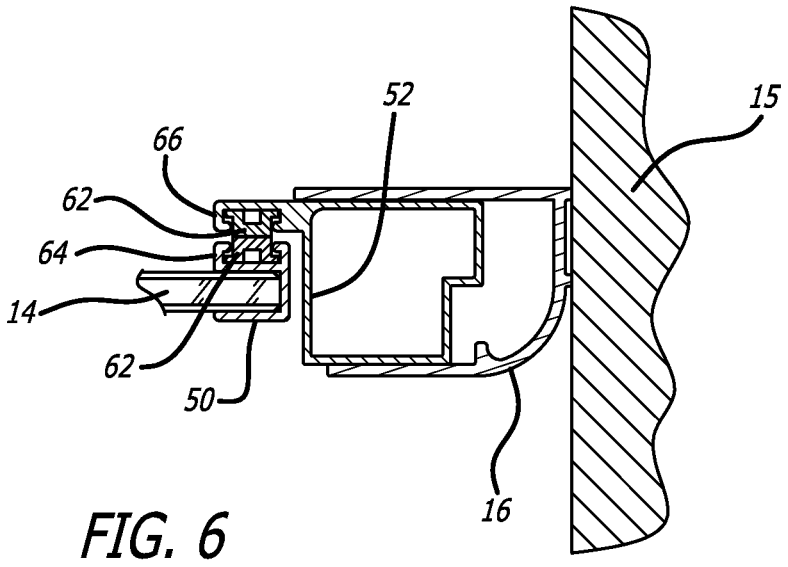
FIG. 6 is an enlarged top plan view of the strike side of the hinged wall profile door assembly of FIG. 1.

FIG. 6 is an enlarged top plan view of the strike side of the hinged wall profile door assembly 12 of FIG. 1.

Figure 7:
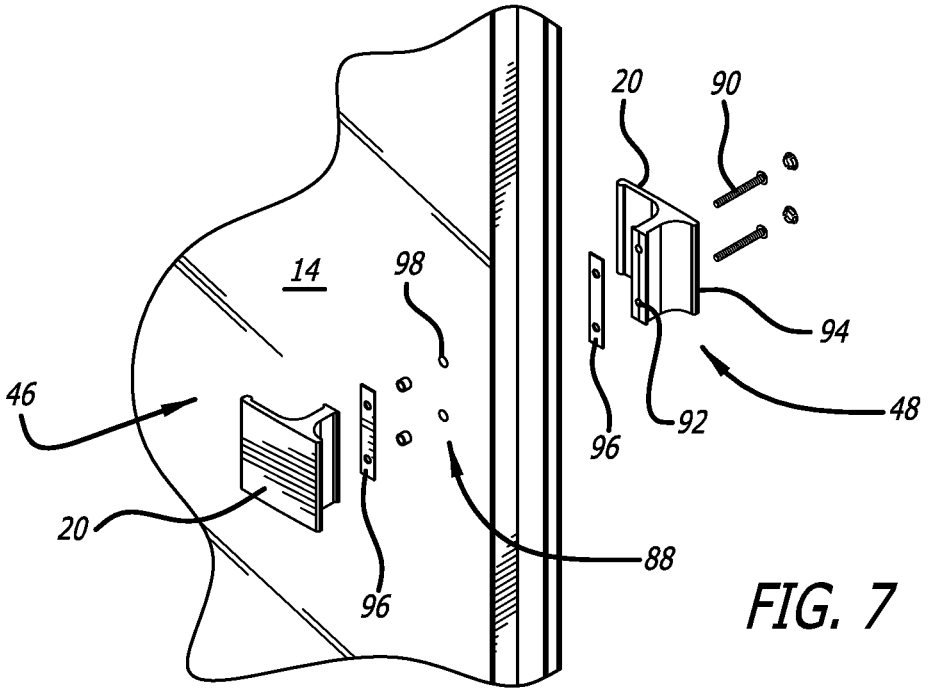
FIG. 7 is an exploded perspective view of a first handle and a second handle of the hinged wall profile door assembly of FIG. 1 from the outside of the exemplary shower enclosure.

FIG. 7 is an exploded perspective view of the first and second handles 20 of the hinged wall profile door assembly 12 of FIG. 1 from the outside of the exemplary shower enclosure. In some embodiments, the first and second handles 20 are configured to be curved such that the curvature of the first and second handles 20 imitates the curve of a human finger (not shown) in an inverse position. It should be understood that the first and second handles may assume other suitable ergonomic positions to enhance comfort and safety by the user during use.

In the illustrated embodiments, the first and second handles 20 are secured on an upper midsection 88 of the profile door 14 from the front side 46 and rear side 48 thereof via at least two fasteners 90 extended therethrough at least two corresponding holes 92 defined on an outer surface 94 of the second handle 20 and a pair of gaskets 96 positioned therebetween the first and second handles 20 in direct communication with the profile door 14.

It should be understood that the fasteners used in conjunction with the various components of the hinged wall profile door assembly 12 of the present disclosure include screws, bolts, bushing nuts, and the like.

In accordance with the present disclosure, the profile door 14 is configured with a plurality of pre-drilled holes 98 therethrough at the upper midsection 88 thereof for securing the first and second handles 20 thereto. Similarly, the profile door 14 is configured with a plurality of pre-drilled holes 100 therethrough adjacent to the top edge 34 and bottom edge 36 thereof for mounting the at least first hinge assembly 18 and second hinge assembly 18 thereto. It should be understood that the profile door 14 is not limited to glass and can be fabricated of other suitable materials for use with a shower enclosure and the hinged wall profile door assembly 12 of the present disclosure.

It should be understood that the various hardware components of the hinged wall profile door assembly 12 can be fabricated of any suitable sturdy material, such as stainless steel, metal alloys, plastic and the like. Similarly, it should be understood that the hinged wall profile door assembly 12 can be fabricated in different finishes, such as polished, brushed, powder coated and the like.

It should be further understood that the hinged wall profile door assembly 12 and various components thereof can be fabricated in different sizes and shapes and are sized to scale the particular shower enclosure selected to be installed in the bathroom space. The various components of the hinged wall profile door assembly, such as the hinge assemblies and handles, can be fabricated by any suitable manufacturing process, preferably, by extrusion.

These and other advantages of the present disclosure will be apparent to those skilled in the art. Accordingly, it will be recognized by those skilled in the art that changes or modifications may be made to the above described embodiments without departing from the broad inventive concepts of the present disclosure. It should therefore be understood that the present disclosure is not limited to the particular embodiments described herein, but is intended to include all changes and modifications that are within the scope and spirit of the disclosure as encompassed by the following claims.

What is claimed is:

1. A hinged wall profile door assembly for a shower enclosure, comprising:

a first longitudinal wall profile and a second longitudinal wall profile, each having a body configured for mounting to a wall;

a longitudinal hinge profile having a body configured to be received within an inner section of the first longitudinal wall profile;

a profile door;

at least a first hinge assembly and a second hinge assembly, each of which is secured to the longitudinal hinge profile adjacent to a top edge and a bottom edge thereof, respectively, the first and second hinge assemblies configured for mounting to the profile door adjacent to a top edge and a bottom edge thereof, the first and second hinge assemblies each having a body and a first end and a second end, wherein the first end of the body is configured to be curved and the second end of the body is configured to form a longitudinal channel for receiving the profile door therethrough;

a first handle configured to be secured to a front side of the profile door and a second handle configured to be secured to a rear side of the profile door such that the first and second handles are positioned directly opposite from each other;

a longitudinal strike rail disposed on a side of the profile door from the top edge to the bottom edge thereof;

a longitudinal strike profile having a body configured to be received within an inner section of the second longitudinal wall profile disposed on an opposite end of the shower enclosure from the first longitudinal wall profile; and a bottom longitudinal strip configured to be disposed on the bottom edge of the profile door for deterring liquid from leaking from the shower enclosure;

wherein:

the first and second hinge assemblies each include a hinge mechanism with a pair of hinge inserts and at least one hinge such that each hinge is configured to be separable, thereby exposing a plurality of pivot pins, and the plurality of pivot pins of each hinge mechanism are disposed therebetween the pair of hinge inserts and include top, middle and bottom pins such that the top pin is configured to be shifted vertically, releasing weight on the middle pin, thereby allowing the top pin and subsequently the other two pins to be removed for replacement of the first and second hinge assemblies without having to uninstall the hinged wall profile door assembly.

2. The hinged wall profile door assembly of claim 1 further comprising:

a side longitudinal strip configured to be disposed on the longitudinal hinge profile with the at least first and second hinge assemblies secured thereto for deterring liquid from leaking from the shower enclosure; and a first magnetic strip pre-installed on a rear side of the longitudinal strike rail and a second magnetic strip pre-installed on an inner surface of the longitudinal strike profile such that the first and second magnetic strips are in direct communication when the profile door is closed.

3. The hinged wall profile door assembly of claim 1, wherein the longitudinal hinge profile is configured to be adjusted when installed within the inner section of the first longitudinal wall profile such that the first and second hinge assemblies are configured to be slidably disposed with the longitudinal hinge profile.

4. The hinged wall profile door assembly of claim 1, wherein the first and second hinge assemblies are mounted to the profile door adjacent to the top edge and the bottom edge thereof via a plurality of fasteners extended therethrough a plurality of corresponding holes defined on an outer surface of a rear side of the body of the first and second hinge assemblies and a pair of gaskets positioned therebetween the first and second hinge assemblies in direct communication with the profile door.

5. The hinged wall profile door assembly of claim 1, wherein the first and second hinge assemblies are manufactured via an extrusion process.

6. The hinged wall profile door assembly of claim 1, wherein the first and second handles are configured to be curved such that a curvature of the first and second handles imitates a curve of a human finger in an inverse position.

7. The hinged wall profile door assembly of claim 1, wherein the first and second handles are secured on an upper midsection of the profile door from the front and rear sides thereof via at least two fasteners extended therethrough at least two corresponding holes defined on an outer surface of the second handle and a pair of gaskets positioned therebetween the first and second handles in direct communication with the profile door.

8. The hinged wall profile door assembly of claim 7, wherein the profile door is configured with a plurality of pre-drilled holes therethrough at the upper midsection thereof for securing the first and second handles thereto.

9. The hinged wall profile door assembly of claim 1, wherein the first and second handles are manufactured via an extrusion process.

10. The hinged wall profile door assembly of claim 1, wherein the profile door is configured with a plurality of pre-drilled holes therethrough adjacent to the top edge and bottom edge thereof for mounting the at least first and second hinge assemblies thereto.

11. A hinged wall profile door assembly for a shower enclosure, comprising:

a first longitudinal wall profile and a second longitudinal wall profile, each having a body configured for mounting to a wall;

a longitudinal hinge profile having a body configured to be received within an inner section of the first longitudinal wall profile;

a profile door;

at least a first hinge assembly and a second hinge assembly, each of which is secured to the longitudinal hinge profile adjacent to a top edge and a bottom edge thereof, respectively, the first and second hinge assemblies configured for mounting to the profile door adjacent to a top edge and a bottom edge thereof, the first and second hinge assemblies each having a body and a first end and a second end, wherein the first end of the body is configured to be curved and the second end of the body is configured to form a longitudinal channel for receiving the profile door therethrough, the first and second hinge assemblies each comprising a hinge mechanism with a pair of hinge inserts and at least one hinge such that each hinge is configured to be separable, thereby exposing a plurality of pivot pins, wherein the plurality of pivot pins of each hinge mechanism are disposed therebetween the pair of hinge inserts and include top, middle and bottom pins such that the top pin is configured to be shifted vertically, releasing weight on the middle pin, thereby allowing the top pin and subsequently the other two pins to be removed for replacement of the first and second hinge assemblies without having to uninstall the hinged wall profile door assembly;

a side longitudinal strip configured to be disposed on the longitudinal hinge profile with the first and second hinge assemblies secured thereto for deterring liquid from leaking from the shower enclosure;

a first handle configured to be secured to a front side of the profile door and a second handle configured to be secured to a rear side of the profile door such that the first and second handles are positioned directly opposite from each other on an upper midsection of the profile door;

a longitudinal strike rail disposed on a side of the profile door from the top edge to the bottom edge thereof;

a longitudinal strike profile having a body configured to be received within an inner section of the second longitudinal wall profile disposed on an opposite end of the shower enclosure from the first longitudinal wall profile;

a first magnetic strip pre-installed on a rear side of the longitudinal strike rail and a second magnetic strip pre-installed on an inner surface of the longitudinal strike profile such that the first and second magnetic strips are in direct communication when the profile door is closed; and a bottom longitudinal strip configured to be disposed on the bottom edge of the profile door for deterring liquid from leaking from the shower enclosure.

* * * * *